US005709637A

United States Patent [19]

Gow et al.

[11] Patent Number: 5,709,637

[45] Date of Patent: Jan. 20, 1998

[54] ROTATOR CUFF STRENGTH TRAINING DEVICE

[76] Inventors: Gordon Gow, 310 Georgian Drive, Barrie, Ontario, Canada, L4M 4Y8; Edward Martin, R.R. 2, Shanty Bay, Ontario, Canada, L0L 2L0

[21] Appl. No.: 744,645

[22] Filed: Nov. 6, 1996

[51] Int. Cl.[6] ..... A63B 21/02

[52] U.S. Cl. ..... 482/129; 422/121; 422/139

[58] Field of Search ..... 482/121, 122, 482/129, 139, 904

[56] References Cited

U.S. PATENT DOCUMENTS

| | | | |
|---|---|---|---|
| 3,652,085 | 3/1972 | Cole | 482/129 |
| 3,677,543 | 7/1972 | Richardson | 482/129 |
| 3,966,204 | 6/1976 | Dubach | 482/129 |
| 4,423,866 | 1/1984 | Stolba . | |
| 4,461,473 | 7/1984 | Cole | 482/139 |
| 4,544,155 | 10/1985 | Wallenbrock et al. . | |
| 4,553,747 | 11/1985 | Pursley . | |
| 4,618,143 | 10/1986 | Twardosz | 482/139 |
| 4,629,184 | 12/1986 | Selkee | 482/139 |
| 4,957,281 | 9/1990 | Christolear, Jr. . | |
| 4,988,098 | 1/1991 | Miller . | |
| 5,016,874 | 5/1991 | Boardman . | |
| 5,080,349 | 1/1992 | Vittone | 482/139 |
| 5,391,132 | 2/1995 | Greenwald . | |
| 5,407,405 | 4/1995 | Oren | 482/139 |
| 5,498,223 | 3/1996 | Iams et al. . | |

*Primary Examiner*—Lynne A. Reichard
*Attorney, Agent, or Firm*—Ridout & Maybee

[57] ABSTRACT

A portable exercise device is provided for specific strength training of the rotator cuff. A cylindrical spool member is provided with a handle across its diameter. A length of rubber exercise tubing is fixed tangentially to one point of the spool, with the other end attachable to a fixed point on an inertial resistance, allowing the user to grip the handle and rotate or move the spool against a continuous resistance for muscle development.

4 Claims, 7 Drawing Sheets

ROTATOR CUFF STRENGTH TRAINING DEVICE

BACKGROUND OF THE INVENTION

This invention relates to a device for exercising and strengthening the rotator cuff muscles of the human body.

The "shoulder joint" actually comprises three separate joints: (i) the ball of the humerus and the glenoid fossa, (ii) the sliding, rotating scapula, and (iii) the pivotal hinge of the clavicle. The rotator cuff muscles, comprising the subscapularis, infraspinatus, teres major, teres minor and supraspinatus muscles are responsible for stabilizing the head of the humerus in the glenoid fossa and for effecting rotation of the head of the humerus in the fossa. In kinesiological terms, these muscles are referred to as "mid-course correctors", by contrast with the larger and more powerful deltoid and pectoral muscles called the "prime movers".

Many competitive sports involve repeated movements by the player or athlete, in which the arm is extended from the shoulder joint and rotated or moved. This can create an uneven antagonistic muscle balance among the mid-course correctors. For example, the frequent swinging of a racquet with a repetitive overhead movement and follow-through can develop a greater level of strength in the internal rotator cuff muscles than in the external rotator cuff muscles. The resulting imbalance can eventually give rise to shoulder injuries specific to the rotator cuff complex.

In the course of any motion in which the angle of the humerus changes relative to the body, the mid-course correctors must be "orchestrated" by the central nervous system to assume their correct functions in the correct sequence. A muscle can function in any one of three modes:

(i) spurt (in which the muscle shortens concentrically);

(ii) shunt (in which the muscle isometrically stabilizes the existing configuration); and (iii) eccentric controlled lengthening.

Thus, with the humerus at 90° abduction from the body, the subscapularis and infraspinatus are in line with the humerus line of force with the scapula. In that position, these three muscles are in the shunt (isometric stabilization) mode. However, if the humerus is at 45° abduction from the body in the act, say, of hitting a tennis ball, then the subscapularis is in spurt mode, acting as a rotator, while the infraspinatus is in the eccentric controlled lengthening mode.

It has been widely recognized that "sports specific" training must be carried out on equipment which offers resistance throughout the full range of muscular motions involved in the sports activity of interest, e.g. punting a football. Only training against resistance through the full range of motion has the desired effect of training the relevant neural pathways in conjunction with the development of increased strength in the muscles involved in a motion or set of movements.

With particular reference to the shoulder joint, a failure in perfect orchestration by the brain of the various and changing spurt, shunt and controlled lengthening modes of the rotator cuff muscles leads to a delay in their entry into their proper successive roles in the motion, with a functional time lag which we refer to as "down time". This can lead, for example, to instability of the humeral head in the glenoid fossa and disabling bursitis of the shoulder. Painful inflammation of the supraspinatus tendon (tendinitis) is another possible consequence. The muscular down time which is the ultimate cause of these sports injuries can be greatly reduced or diminished, by insuring that training equipment offers continuous resistance through the full range of motion of the rotator cuff muscles, i.e., the full 180° rotation of the humerus by the infraspinatus and subscapularis.

Notwithstanding others' recognition of the principles of "sports specific training", commercial equipment and training programs which have to date been used for strengthening the rotator cuff muscles generally fail to bring about coordination between the muscular contractions involved, in synergy with increasing muscular size and strength over the course of training. Professional athletes are not infrequently trained on equipment which supports the arm, or otherwise partially braces or stabilizes the subject, while he or she carries out rotational or flexional movements against a resistance (e.g. weights on pulley arrangements). Such equipment is woefully inadequate in training the nerve pathways to co-ordinate the various muscles for immediate reaction to, say, the arm/joint stresses arising when making a sudden or repeated throwing motion.

Free weights have widely been used in rotator cuff training exercise programs, but these present a major drawback, in that the resistance offered by a free weight depends upon position. In many exercise positions, a free weight is "gravity neutral", affording no resistance whatsoever, inherently leading to a hesitation between muscle reactions during the arm movement. Only resistance offered continuously through the full range of motion generates neural information to the brain which will improve its coordination of the muscle sequencing, a desirable result we refer to as "essential synergy".

The exercise machines which have been devised to replace and improve over free weights in training the rotator cuff muscles are also, for the most part, large, heavy, non-portable and expensive equipment. Those exercise machines whose operation is based on mechanical arms in linear motion are inherently inadequate, because most human arm motion is elliptical. Strength training on a machine of this kind usually results in incomplete development of the muscle complex, particularly as to the subscapularis, because of the restricted range of motion stopping at the torso which the linear-operation machines structurally require.

We have concluded from our work that the optimal route to essential synergy in the training of the rotator cuff muscles is by way of eccentric (not simply linear) control, using a resistance device which provides continuous resistance through the full rotational range of the shoulder joint.

OBJECTS OF THE INVENTION

It is therefore a principal object of the present invention to provide a rotator cuff strengthening device which offers continuous resistance through the full rotational range of the shoulder joint.

It is a further object of the invention to provide an exercise device for strengthening the rotator cuff muscles properly through their full range of movement, while ensuring proper range of movement and balance for all of the muscles involved with the shoulder girdle.

It is a still further object of the invention to provide a device as aforesaid which will be light in weight, readily portable and of relatively low cost compared to apparatus currently available for exercising the rotator cuff muscles.

SUMMARY OF THE INVENTION

With a view to achieving the aforesaid objects and overcoming the aforementioned difficulties of the prior art, the present invention provides a rotator cuff strength training device including a hand-held circular spool with a central axial handle. An extensible elastic strand or cord is attached at one end to the periphery of the spool and at the other end to a fixed point offering inertial resistance, so that the user may rotate the spool of the device against the continuous elastic resistance of the strand.

Preferably, the elastic element will be an ordinary rubber exercise tube, but it will be understood in what follows that "extensible elastic strand" is meant to include all linear Hookean elastic elements that may be wrapped around a wheel or cylinder to exert a resistive torque, such as a solid length of rubber line, an elastic band, a linear spring, etc.

Usually the end of the elastic strand remote from the user will be attached to a fixture on the wall or floor of the room, but resistance to the stretching of the elastic element could be provided by other expedients, such as attaching the remote end of the element to a pulley and weight arrangement.

Since the device is held by the user's hand and the user may position his or her arm at any angle to the body, the continuous resistance provided enables the rotator cuff muscles of the user to be strengthened and essential synergy developed with no neurological down time. As the user changes the angle of the arm, so do some of the responsibilities of the muscles involved change.

Figure 1A:
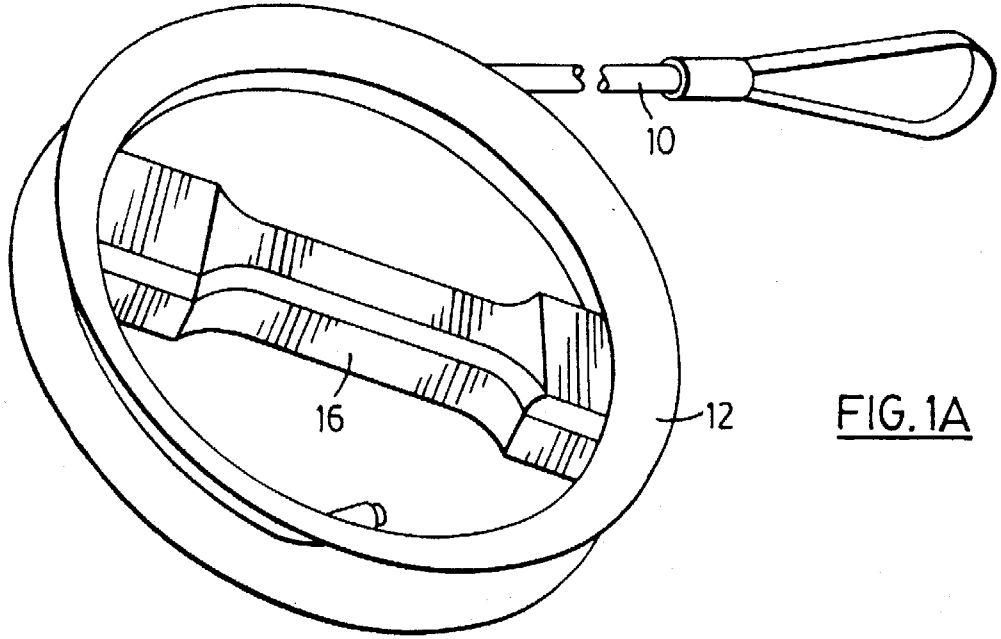
FIG. 1A is a perspective view of a rotator cuff strength training device according to a preferred embodiment of the present invention.
Figure 1B:
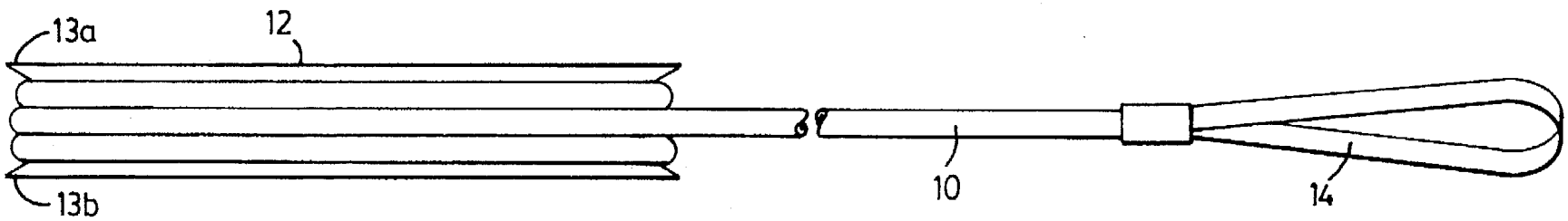
FIG. 1B is a side elevational view of the device of FIG. 1A.
Figure 1C:
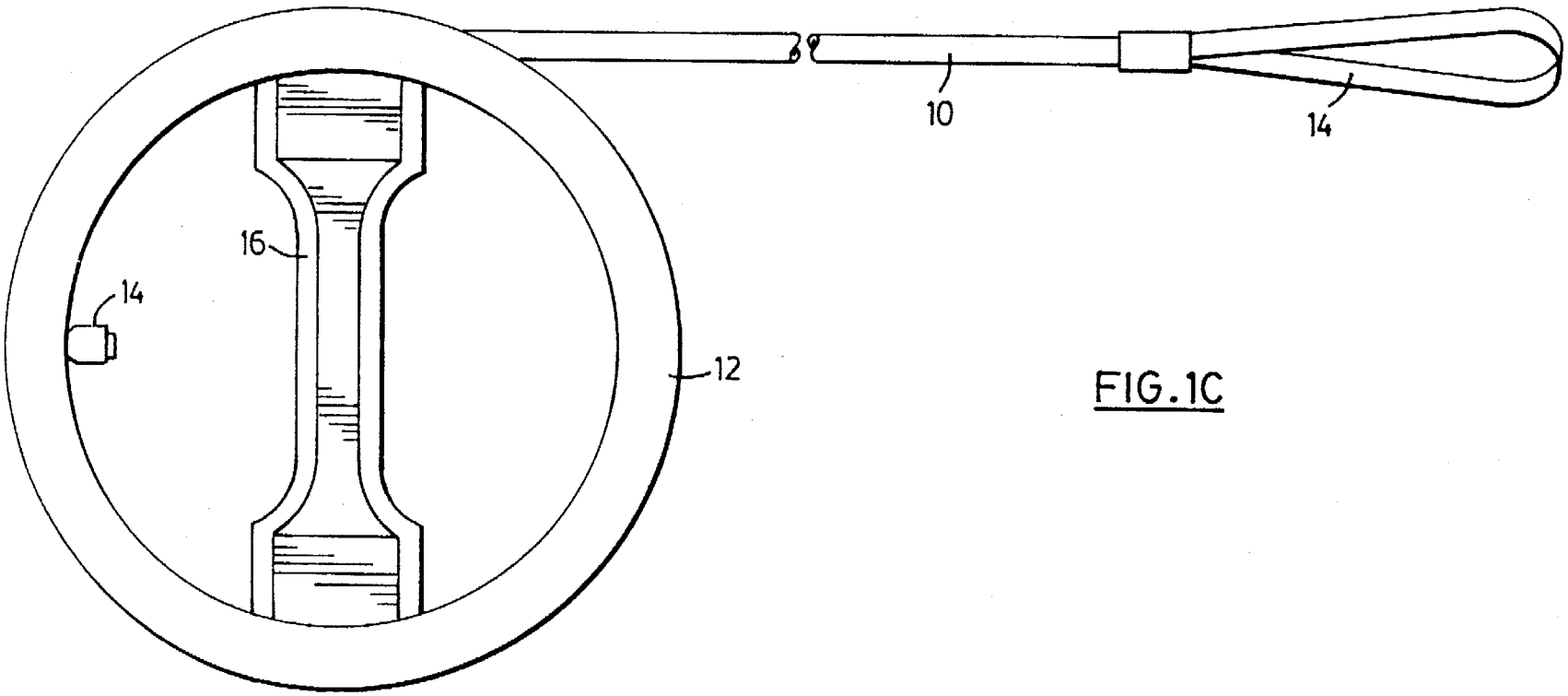
FIG. 1C is a top plan view of the device of FIG. 1C.

As best seen in FIGS. 1A–1C and 2 illustrating the structure and a use of a preferred embodiment of the invention, an extensible elastic strand, specifically a length of rubber tubing 10 is fixed to the outer periphery of a narrow wheel 12 by means of a fixed plug 14 through the rim of the wheel. The other end of tubing 10 is attached to means, here a loop or strip 14 that can be connected with any suitable member 16 (fixed to the wall 18 or the floor). In drawing FIGS. 3A to 5, it will be understood that in each case attachment means 14 is firmly connected to an inertial resistance, such as the wall, the floor, a weight on a pulley, etc.

Wheel 12 includes rims 13*a* and 13*b* which define a central channel to receive the length of rubber tubing 10 as it is wound or unwound by rotation of a transverse handle 16 which is gripped by the user 20.

Example Exercises 1–4 described below in connection with drawing FIGS. 2–5 would be used in a training program for a sport involving a repetitive throwing motion, such as baseball. In throwing a ball, swinging a tennis racquet, etc. the shoulder travels at high speed and it is essential that the mid-course correctors of the shoulder be trained to keep up with the outer prime movers. This is achieved with the device of the present invention by training the mid-course correctors against a continuous resistance, through the full range of their motion.

Example Exercise 1

Figure 2:
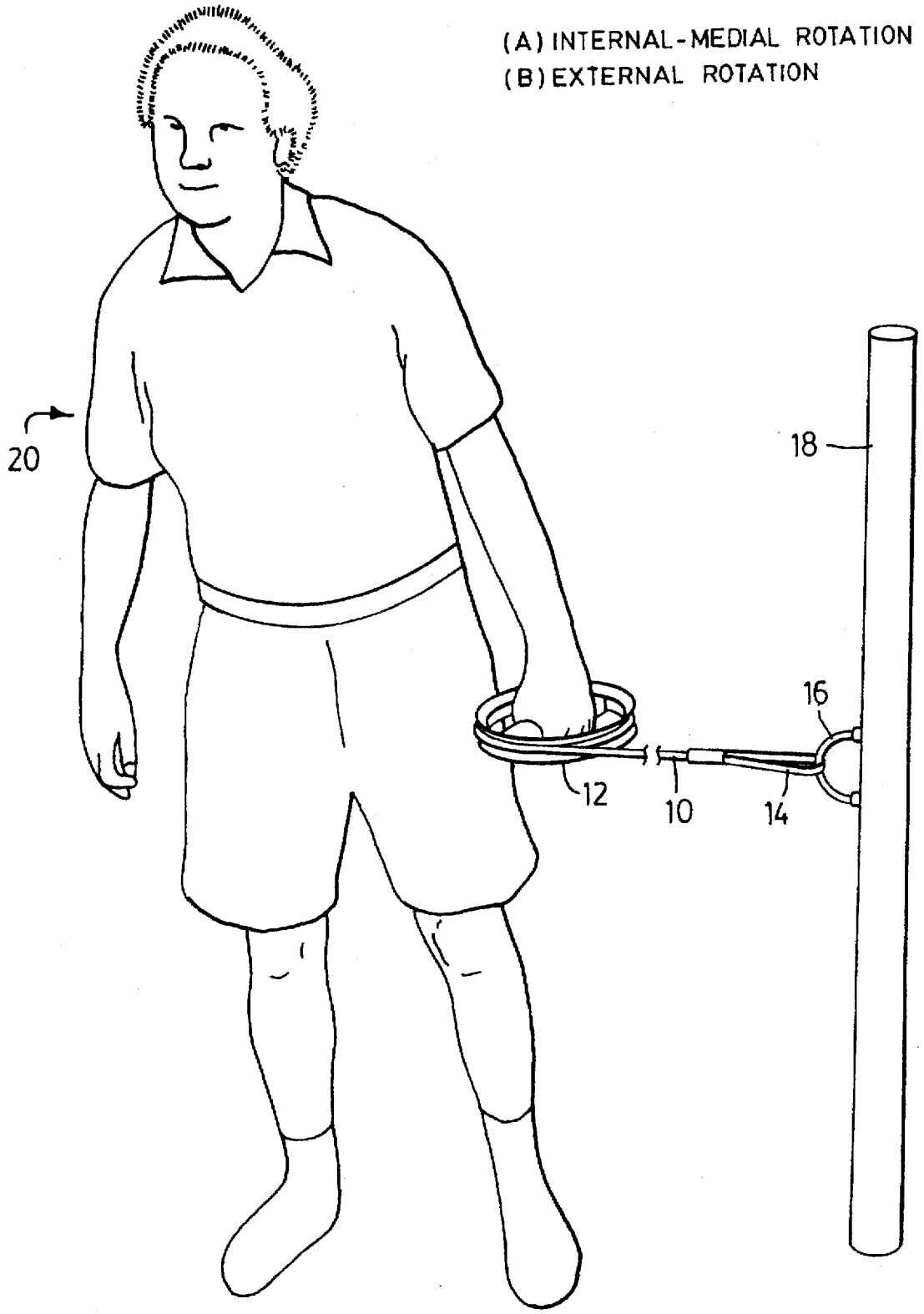
FIG. 2 is a schematic illustration of a user employing the device of FIGS. 1A to 1C in a first mode of exercise.

FIG. 2 shows user 20 gripping the spool of the device by the handle, maintaining it to his side in a horizontal plane, against the resistance of stretched rubber tube 10, and slowly rotating the handle in the horizontal plane either clockwise (internal-medial rotation) or counter-clockwise (external rotation).

This exercise is an illustration of the unique ability of the device of our invention to allow internal rotation of the humerus against continuous and nearly constant resistance, thus exercising the subscapularis to its optimum dynamic range of motion and strength.

By contrast, the widespread current practice is to exercise the subscapularis with the elbow bent at a 90° angle and to measure the strength of that muscle in this same so-called "neutral" position. In fact, that position is far from neutral in the neurological sense; when the arm is bent, the brachial plexus (reflex nerve centre) is fully innervated. Medial rotation of the humerus held in this right-angled position results in the brachial plexus coordinating the prime movers (pectoralis major, anterior deltoid, long head biceps) to become involved in concentric contraction, in conjunction with the subscapularis. These prime movers substantially override any contraction effort made by the subscapularis, so that the conventional exercise and testing gives an unrealistic picture of subscapularis strength.

Moreover, with the elbow bent at 90° and the humerus rotated medially, the exercising motion ends once the forearm reaches the body—about 25° short of the true full range of motion for the subscapularis. The standard current procedure for checking the range of motion of the subscapularis is to move the subject's hand behind his or her back and then raise it away from the body. No current device has the capability of exercising and strengthening this "last" 25° to develop the full range of subscapularis motion without down time (neurological hesitation).

Additionally, when the arm is bent at 90° in the currently prevalent exercise and testing methods for subscapularis, the aforementioned prime movers are involved along with the subscapularis in the medial rotation of the humerus. This leads to inaccurate measurements of the true condition of the subscapularis and can lead to a decision to proceed with corrective surgery on that muscle when it may not be necessary at all.

Example Exercise 2

Figure 3A:
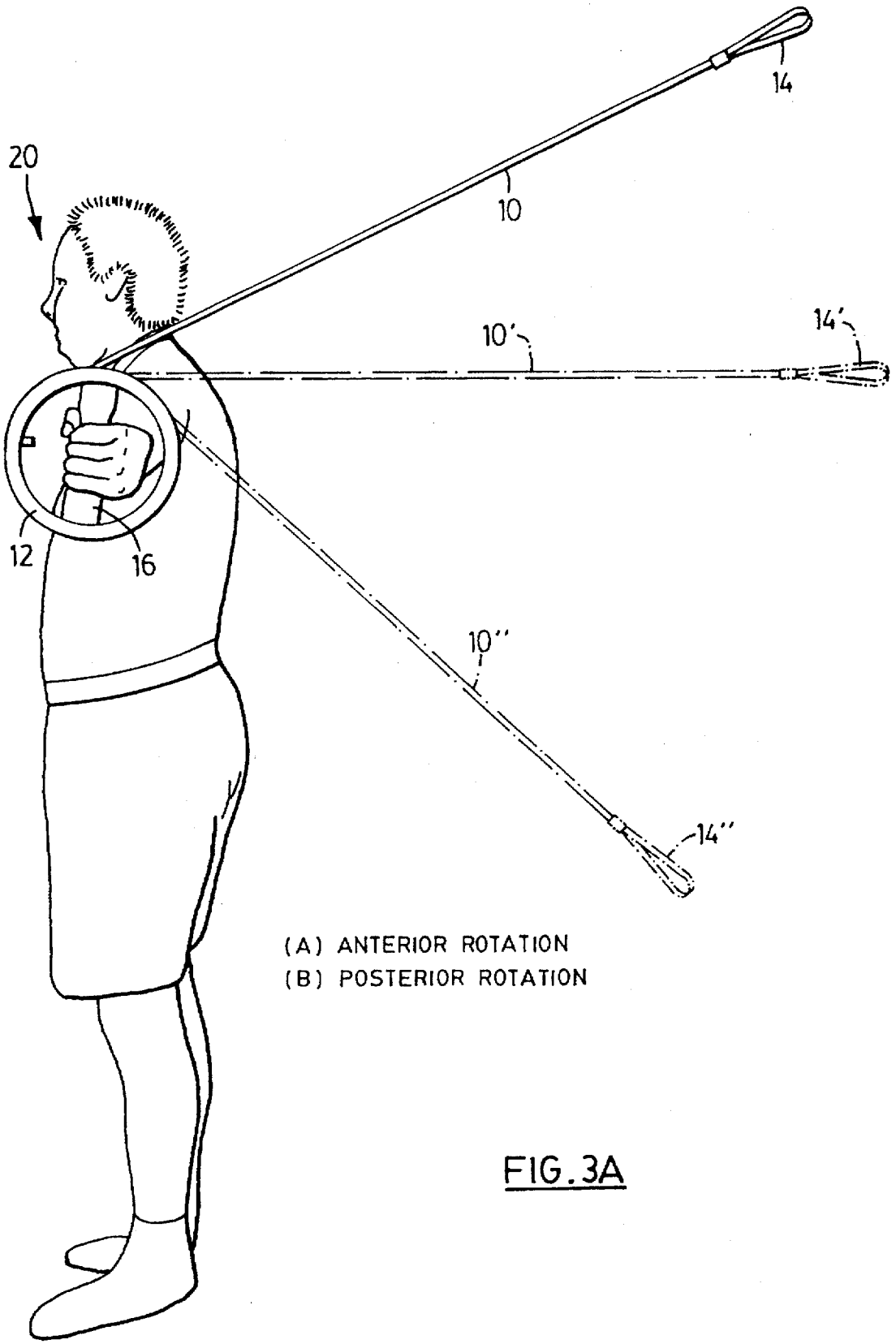
FIGS. 3A and 3B are, respectively, side and top views of a user employing the device of FIGS. 1A to 1C in a second mode of exercise.
Figure 3B:
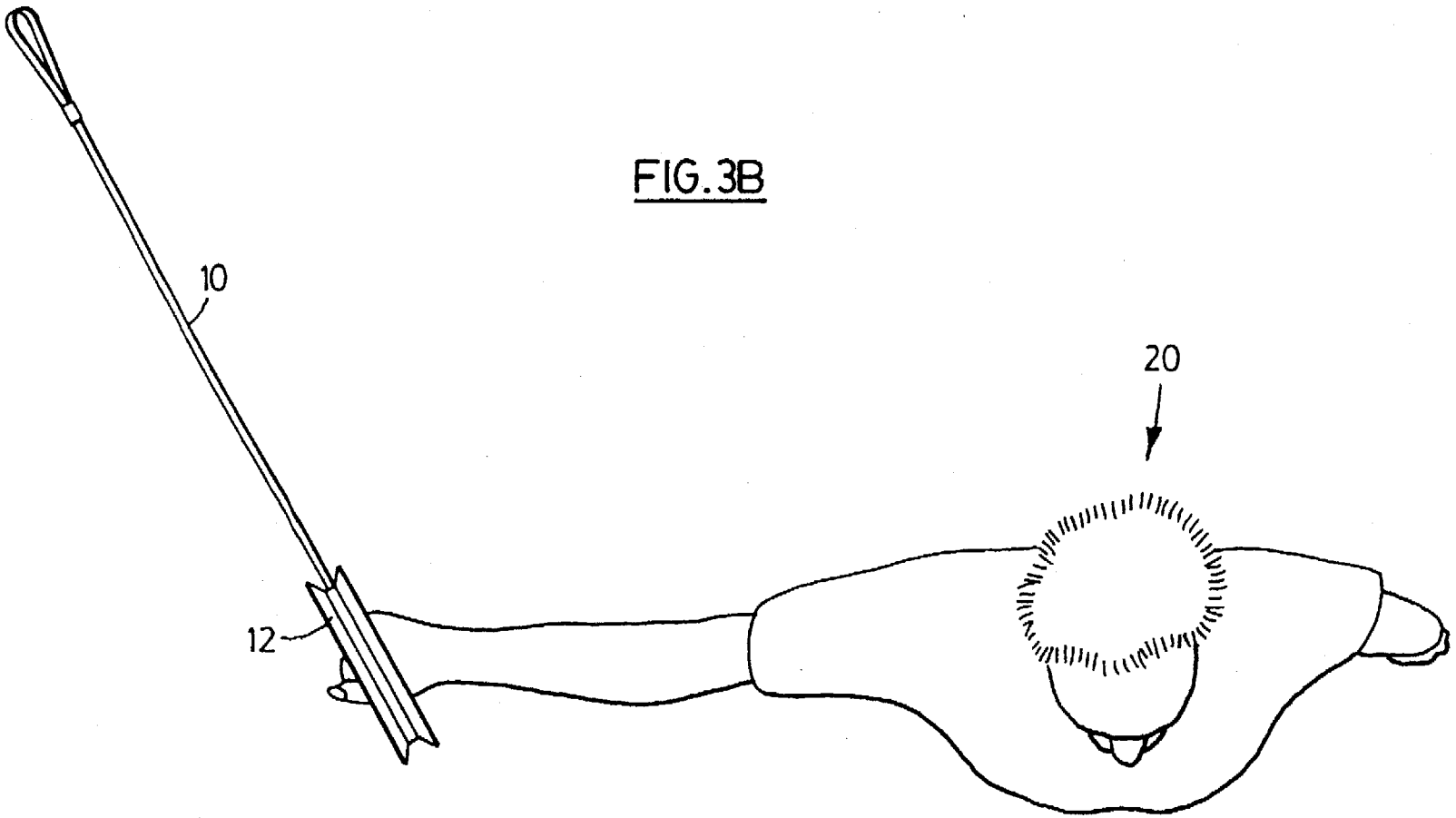

As seen in FIGS. 3A and 3B, the user's arm is abducted to 90° and moved slightly forward in line with the scapula. The attachment means 14 of the tubing may be overhead, horizontally rearward (14') or rearwardly against the floor (14"). As the user rotates handle 16 in an anterior direction, the associated teres major muscle is in the spurt mode and the antagonist teres minor begins to lengthen eccentrically. At the same time, the subscapularis, supraspinatus and infraspinatus are in shunt mode, since these are aligned with and acting as stabilizers to the humerus. The prime movers stabilize the shoulder girdle while the rhomboids, pectoral muscles, deltoid, long head of the biceps, latissimus dorsi and upper trapezius are all in a high degree of shunt.

Example Exercise 3

Figure 4:
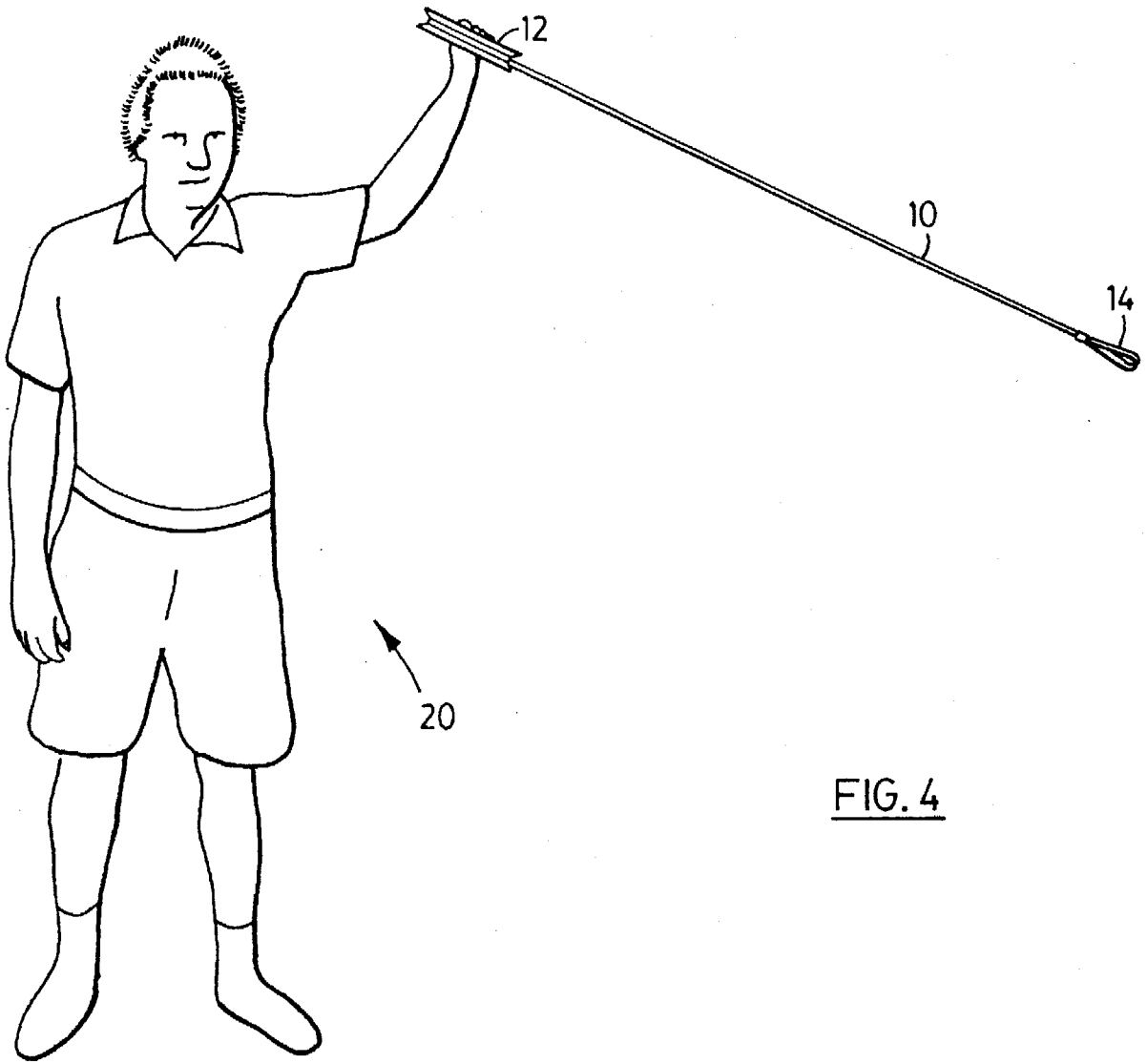
FIG. 4 is a schematic illustration of a user employing the device of FIGS. 1A to 1C in a third mode of exercise.

In this exercise, schematically illustrated in FIG. 4, user 20 holds the grip of wheel 12 upwardly at about a 45° angle with the elbow slightly bent.

Any slight change in humerus height or in its rotation causes the moment arm to change, so that the function of each muscle of the rotator cuff complex changes and, with this, the mode of each of these muscles must change. The present device provides the optimum conditions for insuring a balance between the agonist and antagonist muscles affecting the shoulder and that essential synergy between nervous system and muscles needed to stabilize the head of the humerus in the glenoid fossa during all dynamic motions of the arm. The device of the present invention, indeed permits the training of any conceivable functions that the rotator cuff must make in athletic or other use, because it permits the full range of movement against a constant resistance involving all of the muscles that control the shoulder.

Example Exercise 4

Figure 5:
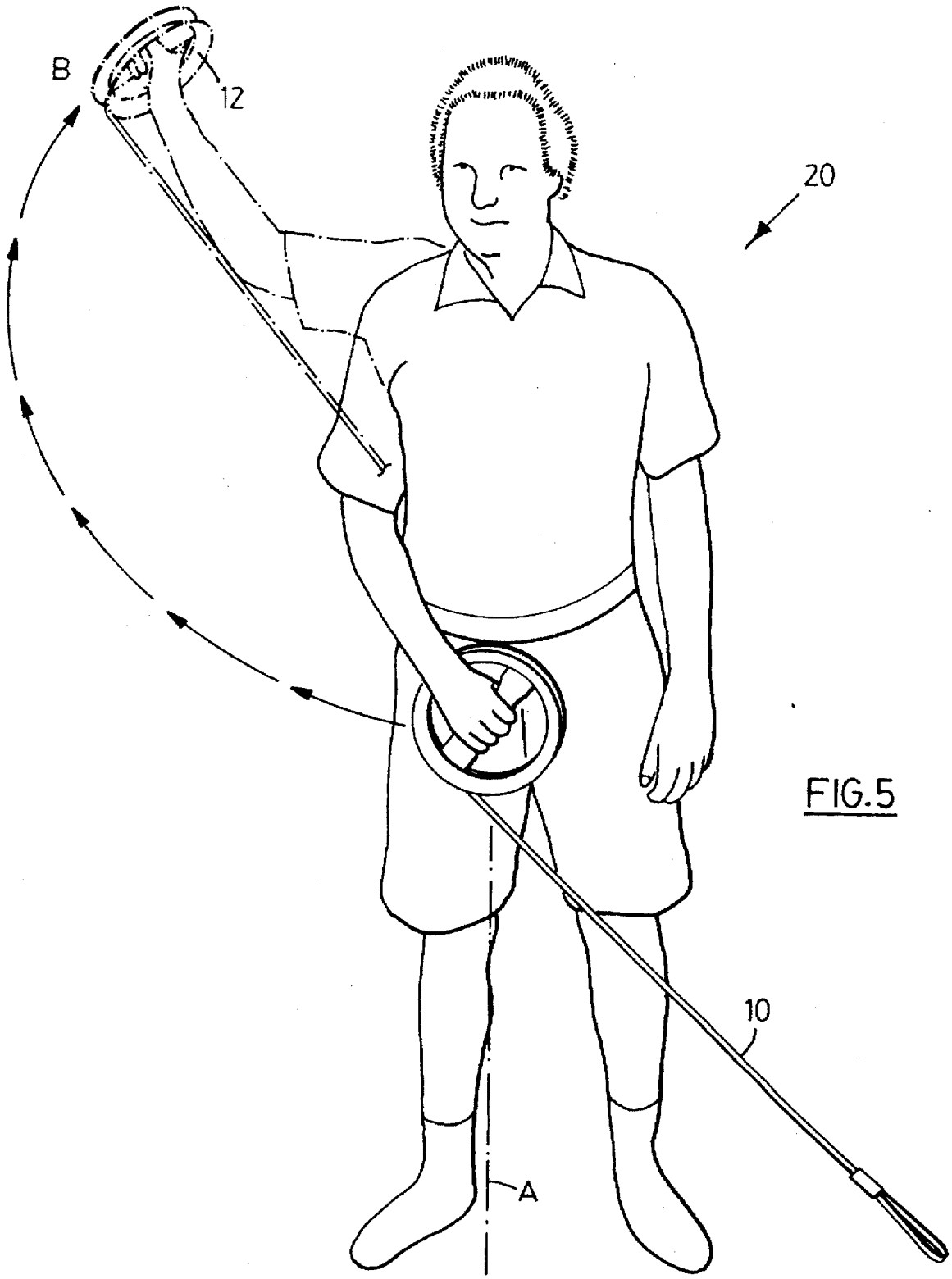
FIG. 5 is a schematic illustration of a user employing the device of FIGS. 1A to 1C in a fourth mode of exercise.

In the exercise illustrated in FIG. 5, the user 20 abducts his arm to the right side from over mid-line A to position B. Over the first part of this lateral swinging motion, the supraspinatus is in the spurt mode but at position B, or close to it, the user's deltoid muscle takes over, because in this abducted position the supraspinatus force is close to being colinear with the humerus, so that it naturally moves into a shunt "stabilizer" mode.

As discussed above, the exercise/training device of the present invention has the salutary effect of "bringing in" different muscles as they smoothly engage and disengage in the course of free movement. Unlike motion-restricted equipment which purports to "isolate" the rotator cuff, the device of the present invention allows the mid-course correctors to alter the trajectory of motion as required. By permitting the user to take the arm through the full range of motion involved in inactivity, against a constant tension, the user's nervous system is trained as well as the muscles, so that "weak points" in the complex of cooperating muscular motions are avoided. By reason of its small size, the device can be carried around anywhere and readily installed outside of a gymnasium or other athletic training facility.

Although only a preferred embodiment of the rotator cuff strength training device of the present invention has been described in detail, it will be apparent that certain modifications and variations are possible without departing from the scope of the invention, which is defined in the following claims.

We claim:

1. A rotator cuff strength training device, comprising:

a length of extensible elastic strand having a first end and a second end;

a spool member of cylindrical symmetry, having an outer circular channel for receiving a length of said elastic strand wrapped therearound;

means for fixing said first end of the strand to a position along said channel of the spool member;

a handle fixed to and extending across said spool member diametrically between opposed positions against said circular channel; and means for fixing said second end of the strand to an inertial resistance, such that with said first and second ends of the elastic strands respectively secured to said channel and to said inertial resistance, a user may by gripping said handle move said spool against continuous resistance.

2. A device according to claim 1, wherein said extensible elastic strand is rubber tubing.

3. A device according to claim 1, wherein said spool member is a narrow wheel with an annular rim and opposed rim flanges defining said circular channel, said handle being fixed to diametrically opposed positions on the inner periphery of said rim.

4. A device according to claim 3, wherein said inertial resistance is rigidly fixed to a wall of a room.

* * * * *